United States Patent [19]

Hatcher

[11] 4,404,697

[45] Sep. 20, 1983

[54] REMOTE CONTROL SYSTEM FOR SPAS

[75] Inventor: Frank L. Hatcher, Ventura, Calif.

[73] Assignee: Intermatic Incorporated, Spring Grove, Ill.

[21] Appl. No.: 933,462

[22] Filed: Aug. 14, 1978

[51] Int. Cl.[3] ..... E04H 3/18

[52] U.S. Cl. ..... 4/492; 4/496

[58] Field of Search ..... 4/172, 172.15, 172.17, 4/178, 180, 488, 489, 492, 493, 494, 495, 507, 508, 509, 510, 538, 540–542; 200/302, 331, 5 A; 362/158; 340/566, 693, 694–696, 225

[56] References Cited

U.S. PATENT DOCUMENTS

| | | | |
|---|---|---|---|
| 3,623,165 | 11/1971 | Whittell, Jr. | 4/172.15 |
| 3,748,457 | 7/1973 | Balitzky | 362/158 |
| 3,778,803 | 12/1973 | Jahn | 340/566 X |
| 3,781,925 | 1/1974 | Curtis | 4/172.15 |
| 3,940,807 | 3/1976 | Baker et al. | 4/172 |
| 3,943,580 | 3/1976 | Carter | 4/172.15 |
| 3,952,338 | 4/1976 | Troxclair | 4/172.15 |
| 3,988,787 | 11/1976 | Colee | 4/172.17 |
| 4,052,757 | 10/1977 | Dotson | 4/172.17 |

OTHER PUBLICATIONS

Sears Catalogue, Fall/Winter/1976, p. 1197.

*Primary Examiner*—Charles E. Phillips
*Attorney, Agent, or Firm*—Ralph B. Pastoriza

[57] ABSTRACT

The normally provided recirculating pump, jet generating action blower and light in a spa are turned on and off by appropriate pump, jet and light signals. These signals are provided by a radio receiver in turn responsive to different transmitted signals. A battery powered hand-held radio transmitter in turn may be manually operated to generate the different signals and thus enable the recirculating pump, jet action generating blower and light in the spa to be operated from a remote location. The system also contemplates the use of switching valves so that the same recirculating pump for the spa can be remotely controlled for recirculating water in a swimming pool should a user also have a swimming pool on the premises.

3 Claims, 2 Drawing Figures

REMOTE CONTROL SYSTEM FOR SPAS

BACKGROUND OF THE INVENTION

Spas or hot tubs are well known in the art and in wide use for therapeutic purposes as well as simple physical relaxation. Basically, these spas include a water recirculating pump, a water jet generating blower and a light. The recirculating pump is usually located close to the spa in a sunken well or in an auxiliary housing. The water jet generating blower may be also disposed close to the spa while the light is normally physically in the bottom central portion of the spa. On/off control switches for these components are normally mounted on a wall of the adjacent dwelling or on a post near the spa.

With either of the foregoing arrangements, if a person sitting in the spa wishes to turn the recirculating pump, water jet generating blower or light on and off, he must get out of the spa and walk over to the appropriate switches.

If a person is in his home and wishes to use the spa, he must start the recirculating pump which normally includes in circuit a thermostat control so that the water of the spa can be brought up to a desired temperature. Again this necessitates a person walking out to the spa or to the corner of the house wall on which the switches are mounted to start these operations. It would clearly be desirable if a person could initiate the recirculating operation as well as turn on the spa light from a remote location such as inside his dwelling so that initial preparations of the spa preparatory to its use can be started without having to leave the house. Such a remote control would be particularly useful at nighttime as the light in the spa could be turned on before leaving the house.

Moreover, it would be desirable if the user of a spa could control the recirculation, jet action and light while actually sitting in the spa so that it is not necessary to climb out of the spa each time some change in operation is desired.

Other problems associated with presently available spa systems is the relative high cost of installation. This high cost results primarily from having to provide various electrical lines between the operating switches and the spa operating components.

Finally, many spa owners also have a swimming pool and it would be a great convenience if recirculating water in the swimming pool and the temperature control thereof could be remotely controlled by the same system employed for controlling the spa.

SUMMARY OF THE INVENTION

Bearing the foregoing in mind, the present invention contemplates a remote control system for spas overcoming the various above-described problems.

More particularly, pump control means are provided responsive to a pump signal to turn the circulating pump on and off, a jet control means is provided responsive to a jet signal for turning the water jet generating blower on and off and a light control means responsive to a light signal is provided to turn the spa light on and off. A radio signal receiver is provided responsive to different transmitted signals for providing the pump signal, jet signal and light signal respectively. A hand-held battery powered radio signal transmitter in turn is provided with manually operable means such as push buttons for respectively transmitting said different signals.

With the foregoing arrangement, water in the spa can be recirculated, jet action initiated and the spa light turned on by a person holding and operating the transmitter from a remote location, such as in an adjacent house.

In the preferred embodiment of this invention, the transmitter is encased in a water-tight housing having a specific gravity less than 1.0 so that it will float. The spa user can then operate the various spa components while sitting in the spa.

Finally, in those instances in which a spa owner also has a pool, a special valve arrangement is provided operable by a valve signal from the receiver in turn responsive to a further manual control on the hand-held ratio transmitter to switch the recirculating pump from recirculating water in the spa to recirculating water in the swimming pool. Appropriate thermostat controls for the spa and swimming pool are automatically actuated by the valve signal when water is being recirculated in one or the other respectively.

As a consequence of the use of radio signals, extensive electrical wiring in the installation of the spa can be avoided with a consequent savings in time and expense.

BRIEF DESCRIPTION OF THE DRAWINGS

A better understanding of this invention will be had by referring to a preferred embodiment as illustrated in the accompanying drawings in which.

DETAILED DESCRIPTION OF THE PREFERRED EMBODIMENT

Figure 1:
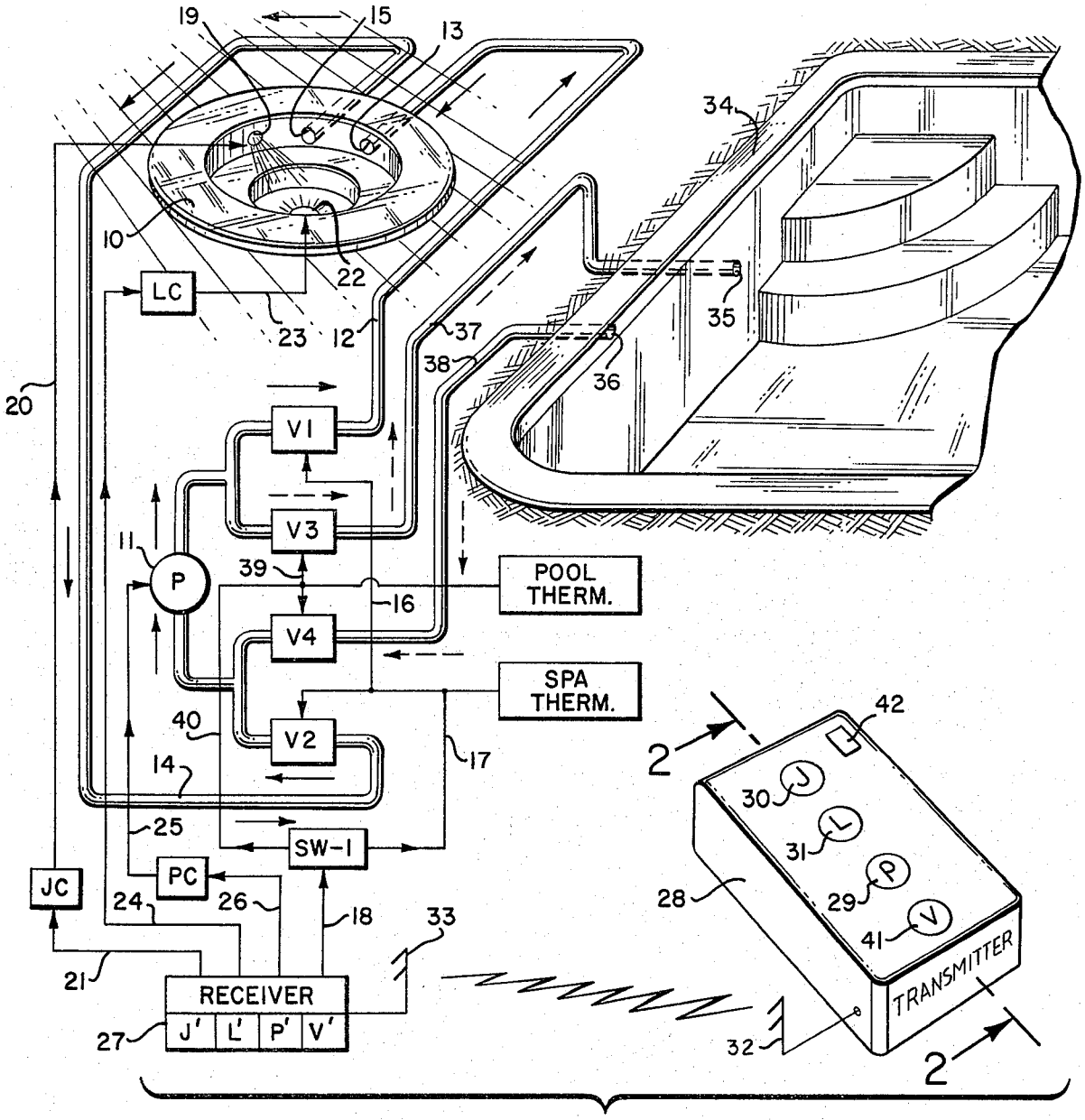
FIG. 1 is a broken away perspective view partly schematic and partly in block diagram form of a spa and swimming pool showing the remote control system of this invention.

Referring first to the upper left portion of FIG. 1 there is shown a typical spa or hot tub 10. Below the spa 10 in the center left portion of FIG. 1 is shown a recirculating pump 11 connected by way of piping 12 to a spa water inlet 13. Return water passes to the pump 11 by way of a pipeline 14 from a spa water outlet 15.

A first valve V1 is provided in the pipe 12 between the spa water inlet 13 and pump 11. A second valve V2, in turn, is provided in the pipe 14 between the spa water outlet 15 and pump 11. First and second valves V1 and V2 are arranged to be operated simultaneously between open and closed positions by a single valve signal provided on an electrical line 16 connecting to both the valves as shown.

The valve signal on line 16 is provided through a branch line 17, a switch SW-1 and line 18.

Referring once again to the spa in the upper left portion of FIG. 1 there is indicated schematically by a numeral 19 a water jet generating blower operated through an electrical line 20 by means of a jet control indicated by the block labeled JC. This jet control is responsive to a jet signal provided on an electrical lead 21.

Spa 10 also includes a light 22 located in the bottom central portion connected by way of lead 23 to a light control means indicated by the block labeled LC. This light control means is responsive to a light signal on an electrical lead 24 for turning the light 22 on and off.

Finally, the pump 11 is connected through electrical line 25 to a pump control means indicated by the block labeled PC in turn responsive to a pump signal on line 26 to turn the pump 11 on and off. The four electrical lines 18, 21, 24 and 26 all connect from a radio signal receiver indicated by the block 27. This radio signal receiver is responsive to different transmitted signals for providing a pump signal on the line 26, a jet signal on the line 21 and a light signal on the line 24.

A hand-held battery powered radio signal transmitter shown in the lower right of FIG. 1 at 28 is provided with manually operable means in the form of push buttons 29, 30 and 31 for respectively transmitting different signals to the receiver 27 by way of antennas 32 and 33.

Referring now to the upper right portion of FIG. 1 there is shown a swimming pool 34 provided with a pool water inlet 35 and pool water outlet 36 connected by way of pipes 37 and 38 respectively to third and fourth valves V3 and V4. These third and fourth valves V3 and V4 are electrically connected for simultaneous operation as indicated by the electrical lead 39 receiving a valve signal on lead 40 from the switch SW-1.

Spa and pool thermostat controls indicated by the blocks labeled SPA THERM. and POOL THERM. are connected to receive the valve signal appearing on line 17 or on line 40 whenever the first and second valves V1 and V2 or the third and fourth valves V3 and V4 are actuated to open positions, respectively.

As described earlier, an appropriate valve signal is provided on the lead 18 from the receiver 27. The generation of this valve signal by the receiver 27 is in response to a further transmitted signal from the transmitter 28 generated in response to manual operation of a push button 41. Transmitter 28 also includes an on/off switch 42.

Figure 2:
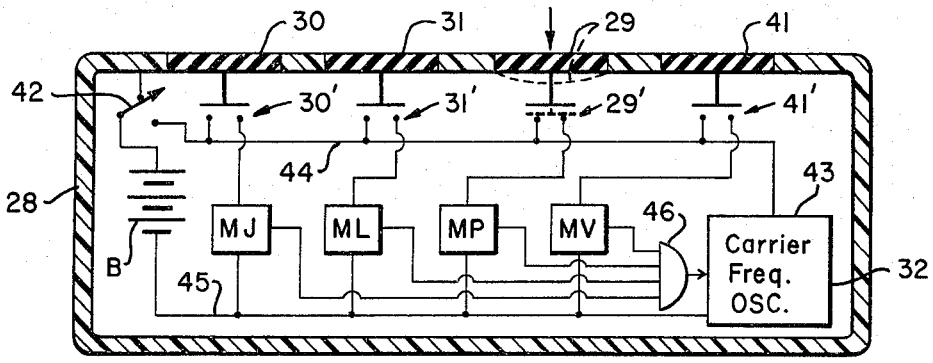
FIG. 2 is a cross section also schematic in form of the radio transmitter components taken in the direction of the arrows 2—2 of FIG. 1.

FIG. 2 illustrates the transmitter 28 in cross section with a schematic diagram of one possible circuit for providing the referred to different transmitted signals.

Referring specifically to FIG. 2, the transmitter 28 comprises a water tight housing preferably of light plastic. The push buttons 29, 30, 31 and 41 include flexible rubber which can be depressed to close appropriate electrical switches indicated at 29', 30', 31' and 41' respectively so that water tight integrity is maintained.

The on/off switch 42 is schematically indicated in FIG. 2, and it is seen that when this switch is closed, power from battery B will be provided to a carrier frequency oscillator 43 by way of a power lead 44. Carrier frequency oscillator 43 connects to the antenna 32 as shown.

Fi rst terminals of the respective switches 29', 30', 31' and 41' connect to the common power lead 44. The second terminals associated with each of the switches in turn connect to modulators shown by the blocks labeled MP, MJ, ML, and MV, respectively so that when any one of the push button switches 29', 30', 31' or 41' is depressed, power from battery B will be supplied to the corresponding modulator.

A return lead 45 connects the ground side of the carrier frequency oscillator 43 and of the various modulators to the battery B as shown. The outputs from each of the modulators connect through an "OR" circuit 46 to the carrier frequency oscillator 43. Essentially, the carrier frequency oscillator will be either amplitude or frequency modulated by a different signal from the modulators depending upon which one is energized, so that a distinct radio frequency signal will be associated with each push button switch.

Referring once again to the receiver 27 of FIG. 1, there is indicated by the lettered blocks P', J', L' and V' appropriate demodulators for detecting the different signals from the transmitter and providing a pump signal, jet signal, light signal or valve signal on the lines 26, 21, 24 and 18 respectively.

The transmitter as described in FIG. 2 is not only water tight but also has a specific gravity less than 1.0 so that it will float.

OPERATION

If only a spa is to be controlled; that is, there is no swimming pool, the valves V1, V2, V3 and V4 can be eliminated and the spa water inlet pipe 12 connected directly to the outlet of pump 11 and the spa water outlet pipe 14 connected directly to the other side of the pump. In this event, the thermostat control for the spa would be connected to the electrical line 25 so as to receive the pump signal.

The provision of the valves V1 through V4 merely permits the same circulating pump 11 to be utilized for controlling the recirculation of water in the pool 34.

When the on/off switch 42 on the transmitter 28 is closed, power as described is supplied to the carrier frequency oscillator. If now the pump signal push button 29 is depressed to close the switch 29' as shown in FIG. 2, power will be supplied from the battery B to the modulator MP. The other modulators will remain off. The output signal from the modulator MP passes through the "OR" circuit 46 to the carrier frequency oscillator and will either frequency or amplitude modulate the carrier frequency signal.

The signal is transmitted to the receiver 27 shown in FIG. 1 and a demodulator P' provides the required pump signal on the line 26 to actuate the pump control PC. This pump control will then turn on the pump 11 to circulate water through the valve V1, pipe 12 and spa water inlet 13, the water returning through spa water outlet 15, pipe 14, valve V2 to the pump 11.

If the pump button switch 29 is again depressed, a subsequent signal will operate the pump control PC to turn the pump 11 off. In other words, a bistable switch is provided in the pump control so that successive signals turn the pump on and off respectively.

With respect to the above-described operation, the push button switches 29, 30 and 31 and 41 are biased to normally open positions.

If it is desired to start the water jet generating blower the push button 30 is depressed to close the switch 30' and thereby actuate the modulator MJ. The output signal from this modulator will modulate the carrier frequency in a different manner to provide a different modulated transmitted signal which is only detected by the demodulator J' in the receiver 27, to thereby provide the jet signal on line 21. As in the case of the pump control, the jet control JC will then start the water jet generating blower. As also in the case of the operation of the pump, successive jet signals will turn the jet on and off.

If the light button 31 is depressed to close the light switch 31' in the transmitter of FIG. 2, the modulator ML will be energized to again modulate the carrier frequency oscillator to provide yet a different transmitted signal which is demodulated by the demodulator L' in the receiver to provide a light signal on line 24 to the light control LC. Successive operations of the light button will turn the light on and off.

Finally, where a pool 34 is provided together with the valves V1 through V4, operation of the valve button 41 to close the valve switch 41' in FIG. 2 actuates the modulator MV which will modulate the carrier frequency oscillator at an appropriate different transmitted signal received by demodulator V' in the receiver, thereby providing a valve signal on line 18. Successive valve signals on line 18 are switched alternately between lines 17 and 40. Thus, assume that a first depression of the valve switch provides a valve signal on line 18 to the switch SW-1. This valve signal will actuate the switch to throw it from its previous set position. Since the first and second valves V1 and V2 were open to operate recirculation of water in the spa, the subsequent signal on line 18 will turn off or close the valves V1 and V2 by removing the signal from line 17 and switching it to line 40. This signal will then actuate the third and fourth valves V3 and V4 by way of the connecting lead 39 to thereby recirculate water from the pump 11 to the valve V3, pipe 37 to water inlet 35 and back through water outlet 36, pipe 38 and valve V4 to the pump 11. When the valve signal is next provided, the switch SW-1 will remove the signal from line 40 and reconnect it to lines 17, thereby opening the valves V1 and V2 and closing the valves V3 and V4.

As noted heretofore, these same valve signals will simultaneously operate the spa thermostat control or the pool thermostat control depending upon which valve sets are opened.

The term "water jet generating blower" as used herein refers to an electrically operated air blower for bubling or churning the water in the spa. In this respect, the "jet" could be the bubling water from several openings in the spa seat or floor. The actual physical jetting of water from side openings can be effected by the water pump. Accordingly, the term, as used, is meant to be comprehensive to an air blower for churning or jetting the water in any desired manner.

Further, while an on-off switch has been shown and described on the hand held battery powered transmitter, the same could be energized solely by the operation of one of the manually operable means by using appropriate circuitry.

Finally, while electrical leads have been shown connecting to the various valves in FIG. 1, these valves can be hydraulically actuated by single signal operating suitable solenoid controls.

From all of the foregoing, it will thus be evident that the present invention has provided a very convenient remote control system for spas and/or pools wherein the user can operate the various controls from inside a house if desired. Moreover, the use of the remote control system greatly facilitates installation of wiring and piping and the like since the signal responsive controls can all be located at one particular place.

Since the transmitter is water tight and will float, it can be used while a person is sitting in the spa to control the jet action and light as well as water recirculation without the person having to get out of the spa.

I claim:

1. A remote control system for spas wherein the spa has a water recirculating pump for passing water into a spa water inlet in the spa and receiving water from a spa water outlet and wherein the spa further includes a water jet generating blower and a light, said control system including in combination:

(a) pump control means responsive to a pump signal to turn said pump on and off;

(b) a radio signal receiver responsive to a transmitted signal for providing said pump signal;

(c) a jet control means responsive to a jet signal for turning said water jet generating blower on and off, said radio signal receiver being responsive to a different transmitted signal for providing said jet signal;

(d) a light control means responsive to a light signal to turn said light on and off, said radio signal receiver being responsive to a still different transmitted signal for providing said light signal; and, (e) a hand-held battery powered radio signal transmitter having manually operable means for transmitting said transmitted signal, manually operable means for transmitting said different transmitted signal and manually operable means for transmitting said still different transmitted signal, said transmitter being encased in a watertight housing and having a specific gravity less than 1.0 so that it will float whereby water in the spa can be recirculated, the said water jet generating blower turned on and off and the light turned on and off by a person holding and operating said transmitter from a remote location as well as when sitting in said spa.

2. A system according to claim 1, in which said system includes a swimming pool having a pool water inlet and a pool water outlet and further includes first and second valves connected between said spa water inlet in said spa and said pump and between said spa water outlet and said pump respectively and responsive to a valve signal to switch both said first and second valves simultaneously between open and closed positions; and third and fourth valves connected between said pool water inlet and said pump and between said pool water outlet and said pump respectively and responsive to said valve signal to switch both said third and fourth valves simultaneously between closed and opened positions, said receiver being responsive to a further transmitted signal to provide said valve signal, and said transmitter having a further manually operable means for transmitting said further transmitted signal whereby said recirculating pump can be used to recirculate water in said pool when not being used to recirculate water in said spa.

3. A system according to claim 2, including a thermostat control for said spa connected for actuation by said valve signal when said first and second valves are opened and a thermostat control for said pool connected for actuation by said valve signal when said third and fourth valves are opened.

* * * * *